United States Patent [19]

Uehara

[11] Patent Number: 4,731,767

[45] Date of Patent: Mar. 15, 1988

[54] TIMEPIECE HAVING A STAR DISPLAY

[75] Inventor: Hideo Uehara, Tanashi, Japan

[73] Assignee: Citizen Watch Co., Ltd., Tokyo, Japan

[21] Appl. No.: 918,976

[22] Filed: Oct. 15, 1986

[30] Foreign Application Priority Data

Oct. 15, 1985 [JP] Japan ..... 60-229170
Oct. 15, 1985 [JP] Japan ..... 60-229169

[51] Int. Cl.[4] ..... G04B 19/26
[52] U.S. Cl. ..... 368/15
[58] Field of Search ..... 368/15–20, 368/223

[56] References Cited

U.S. PATENT DOCUMENTS 521,725 6/1894 Molesworth ..... 368/15
2,657,525 11/1953 Allen ..... 368/15
4,435,795 3/1984 Frank ..... 368/16

FOREIGN PATENT DOCUMENTS 480518 2/1938 United Kingdom ..... 368/15

OTHER PUBLICATIONS

Popular Science, Jul. 1949, p. 153.

*Primary Examiner*—Vit W. Miska
*Attorney, Agent, or Firm*—Birch, Stewart, Kolasch & Birch

[57] ABSTRACT

A wristwatch with a star map disk rotatably mounted in a caser and a gear train for rotating the star map disk at a speed of one revolution per one sidereal day. A star map is provided on the star map disk. The star map includes bright and constellation figures in a part of the celestial sphere which are selected from visible stars. The dial of the wristwatch has an opening for defining a range of the star map which is visible when observing.

14 Claims, 8 Drawing Figures

TIMEPIECE HAVING A STAR DISPLAY

BACKGROUND OF THE INVENTION

The present invention relates to an electronic timepiece having a star display.

There has been proposed an electronic wristwatch having a star map on a star map disk which is rotatably mounted under a dial of the watch. The dial has an opening through which a part of the star map is disclosed to display constellation figures. The disk is simultaneously driven with hour, minute and second hands by a single power source and is adapted to rotate one revolution per one sidereal day.

In such a watch, if an additional function for discerning twilight is provided, it would be very useful not only for astronomical observation, but also for usual outdoor activity, since outdoor activity is possible in the twilight.

However, it is difficult to provide a device which discerns the twilight accurately.

The interval of time, during which the sun is between the horizon and 6.5 degrees below the horizon, is called a civil twilight. The interval of time, during which the sun is between 12 and 18 degrees below the horizon, is called an astronomical twilight. In the civil twilight, the brightest planet can be observed.

In order to discern twilight conditions, an accurate solar position in the celestial sphere (right ascension and declination), the latitude of the observation point, and the local sidereal time are necessary. However, a moving rate of the sun in the ecliptic in the celestial sphere is not constant because the revolution orbit of the earth is an ellipse. Further, the ecliptic crosses the celestial equator at an angle of about 23.5 degrees and the declination of the sun has seasonal variation. Therefore, accurate solar position cannot be indicated, for example, by means of a hand uniformly rotating one rotation per day.

Further, in the prior art, stars and constellation figures in a northern part of the northern celestial hemisphere, namely circumpolar stars and constellations around the stars, are not included. Accordingly, such a watch does not meet requirements of users.

SUMMARY OF THE INVENTION

An object of the present invention is to provide an electronic timepiece having star maps for widely displaying stars and constellations in a celestial sphere.

Another object of the present invention is to provide an electronic watch having a rotary disk for a star map in which a gear train for driving the disk is simple in structure.

A further object of the present invention is to provide an electronic watch by which the twilight can be discerned.

According to the present invention, there is provided a timepiece having a case, an hour wheel carrying an hour hand, a minute hand, a dial, means for driving the hands, a star map disk disposed coaxially with an axis of the hour hand wheel and rotatably mounted in the case, gear train means for transmitting rotation of the hour wheel to the star map disk to rotate the disk one revolution per one sidereal day, and a first star map provided on the star map disk.

The first star map includes bright and constellation figures in a part of the celestial sphere which are selected from visible stars at an observation point on the earth and are arranged around one of the celestial poles which is disposed at the center of the star map disk.

An opening is formed in the dial for disclosing a part of the first star map and for defining a range of the first star map which is visible when observing. Further, a second star map having stars in a range other than that of the first star map is provided in the watch.

In an aspect of the present invention, the opening of the dial has a substantially crescent shape including a line showing a horizon and a line defined about the zenith, the first star map includes a part of the southern part of the celestial sphere and the second star map includes circumpolar stars. Further, the dial has two openings including lines for defining a twilight.

These and other objects and features of the present invention will become more apparent from the following description with reference to the accompanying drawings.

DESCRIPTION OF THE PREFERRED EMBODIMENTS

Figure 1:
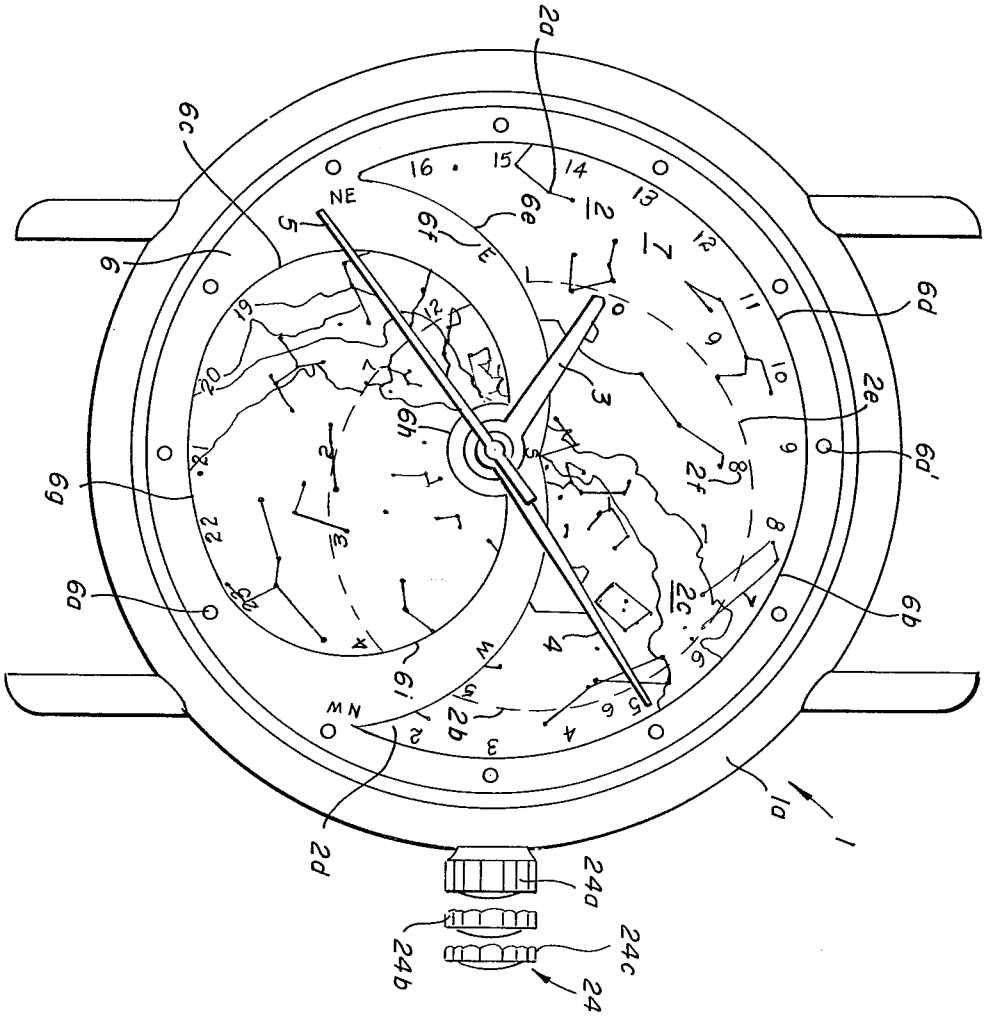
FIG. 1 is a plan view of an electronic wristwatch having a constellation display according to the present invention.

Referring to FIG. 1, an electronic wristwatch 1 of an analog time-display comprises a watchcase 1*a*, a star map disk 2 having a first star map printed thereon and rotatably mounted in the watchcase 1*a*, a dial 6 secured to the watchcase 1*a* over the star map, and a first star display 7. An hour hand 3, a minute hand 4 and a second hand 5 are coaxially provided in the center of the dial 6. The dial 6 has twelve markers 6*a* for representing from one to twelve hours by the hour hand 3, an opening 6*b* for displaying a part of the star map, and a window 6*c* having a function for discerning twilight. Thus, first star display 7 is composed of the star map on the disk 2, opening 6*b* and window 6*c* of the dial 6. Consequently, a part of the star map on the disk 2 disposed under the dial 6 can be seen through opening 6*b* and window 6*c*. A marker 6*a*′ represents 12 o'clock and the position of the meridian.

Figure 2:
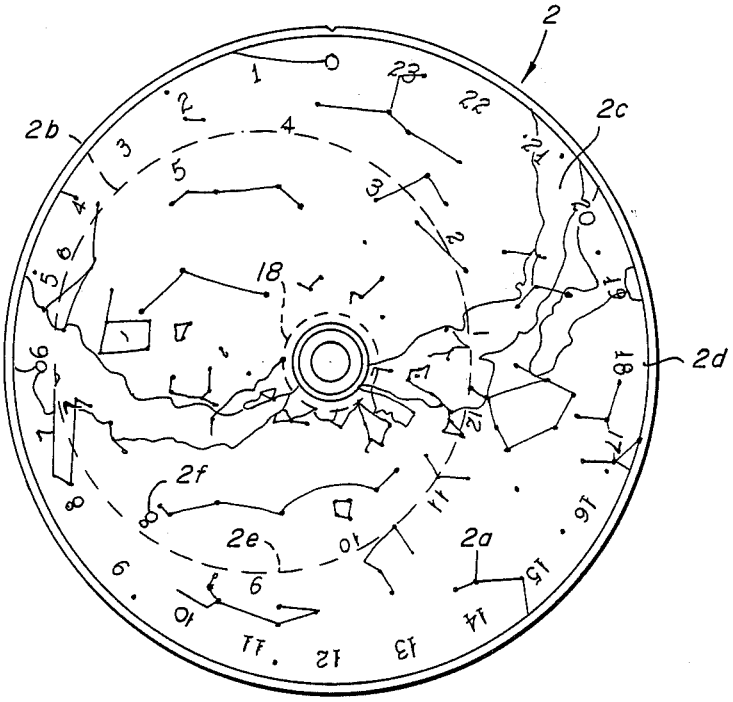
FIG. 2 is a plan view of a rotary disk having a first star map provided in the watch.

Referring to FIG. 2, the star map shows a southern part of the celestial sphere with respect to the zenith at an observation point at a north latitude of 35°. This part is a range from −55.6 to +35 degrees declination, which takes into account the horizontal refraction of 0.6 degrees caused by the atmospheric refraction. The star map 2 has main bright stars, various constellation figures 2*a*, the ecliptic 2*b* indicated by a broken line, and the Milky Way 2*c*, which are selected from visible stars in the southern part of the celestial sphere and circularly arranged around the center of rotation of the disk 2

(corresponding to the celestial south pole). Namely, visible stars near the celestial south pole are disposed adjacent to the center of the disk 2 and stars passing near the zenith are disposed in a circumferential portion of the disk 2, disposing lines of declination at equidistance.

The disk 2 further has numerals 2d consisting of 0 to 23 provided in order of the counterclockwise direction on the outermost periphery thereof for indicating times of the right ascension. In the broken lines of the ecliptic 2b, there are 36 breaks between lines. Each of breaks represents a solar position 2e at noon (Japanese standard time) on the first, eleventh and twenty first of each month in the mean year. That is, three broken lines represent one month, so that each of numerals 2f from 1 to 12 for indicating twelve months is disposed at a position corresponding to the first of each month.

As shown in FIG. 1, the opening 6b formed in the dial 6 has a substantially crescent shape and curved edges for defining the opening 6b comprises an arc 6d showing +35 degrees declination of a northern limit in the first star display 7 and a horizon curve 6e showing the horizon in latitude 35° N. Namely, the opening 6b resembles a southern sky in shape at the observation point. Along the horizon curve 6e, characters 6f of NE, E, SE, S, SW, W, NW, each showing direction, are provided on the dial 6. The window 6c is defined by the arc 6g of +35 degrees declination, a small arc 6h and curve 6i. The arc 6h shows −55.6 degrees declination and curve 6i shows the definition of an astronomical twilight at 108 degrees zenith distance at a latitude of 35° N.

In the first star display 7, the time of right ascension 2d corresponding to the marker 6a' represents the sidereal time. Further, a solar position on the celestial sphere on a desired date is indicated by a corresponding date on the ecliptic 2b. The twilight is indicated as follows. When the solar position on the desired date on the ecliptic 2b is positioned within the window 6c, the twilight has not yet occurred. It is a day time when the solar position is within the opening 6b. During the twilight, the solar position is hidden under the dial 6 between the horizon 6e and the limit line 6i.

Figure 3:
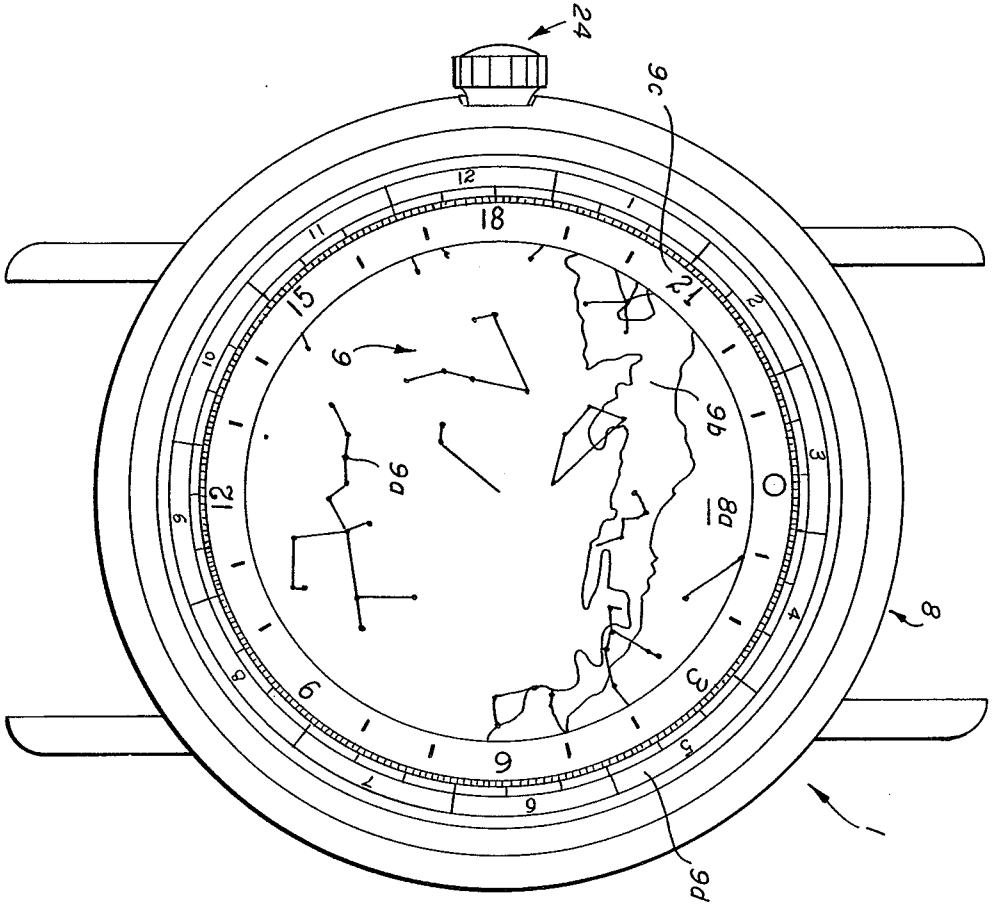
FIG. 3 is a plan view of a back of the watch in FIG. 1 having a second star map.

Referring to FIG. 3, a second star display 8 having a star map of the northern sky is provided on a back 9 of the wristwatch 1. The second star display 8 comprises a second star map 8a, and peripheral portions for the times of the right ascensions 9c and date 9d. The star map shows the celestial sphere from +35 degrees declination to the north celestial pole, which is not displayed in the first star display 7 and has main bright stars, various constellation figures 9a and the Milky Way 9b in the same manner as the first star display 7. The times of right ascensions 9c are composed of indexes and numerals 0, 3, 6, 9, 12, 15, 18 and 21 disposed between indexes at every angle of 45 degrees. By angularly disposing the watch 1 such that the time of right ascension 9c corresponding to the sidereal time read from the time of the right ascension 2d in the first star display 7 at a time is oriented to the celestial meridian, positions of the constellations in the northern celestial sphere are indicated by the star map. The date portion 9d has numerals showing twelve months, each of which has graduations for days corresponding to the times of right ascensions 9c for indicating the sidereal time at noon in the mean year in the Japanese standard time longitude (at longitude 135° E).

Figure 5:
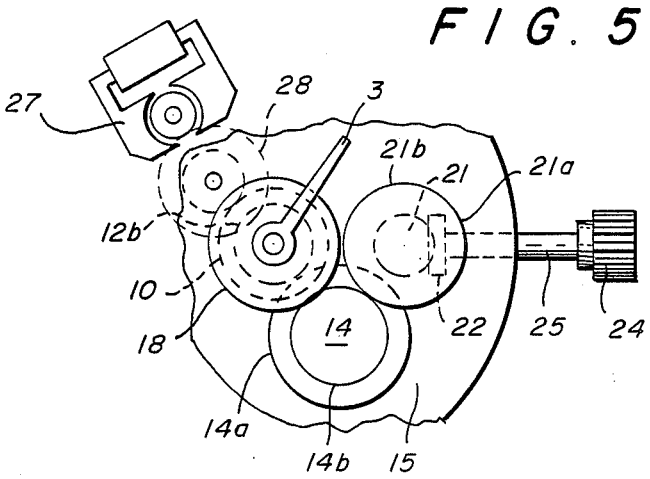
FIG. 5 is a schematic plan view of a part of the gear train.
Figure 4:
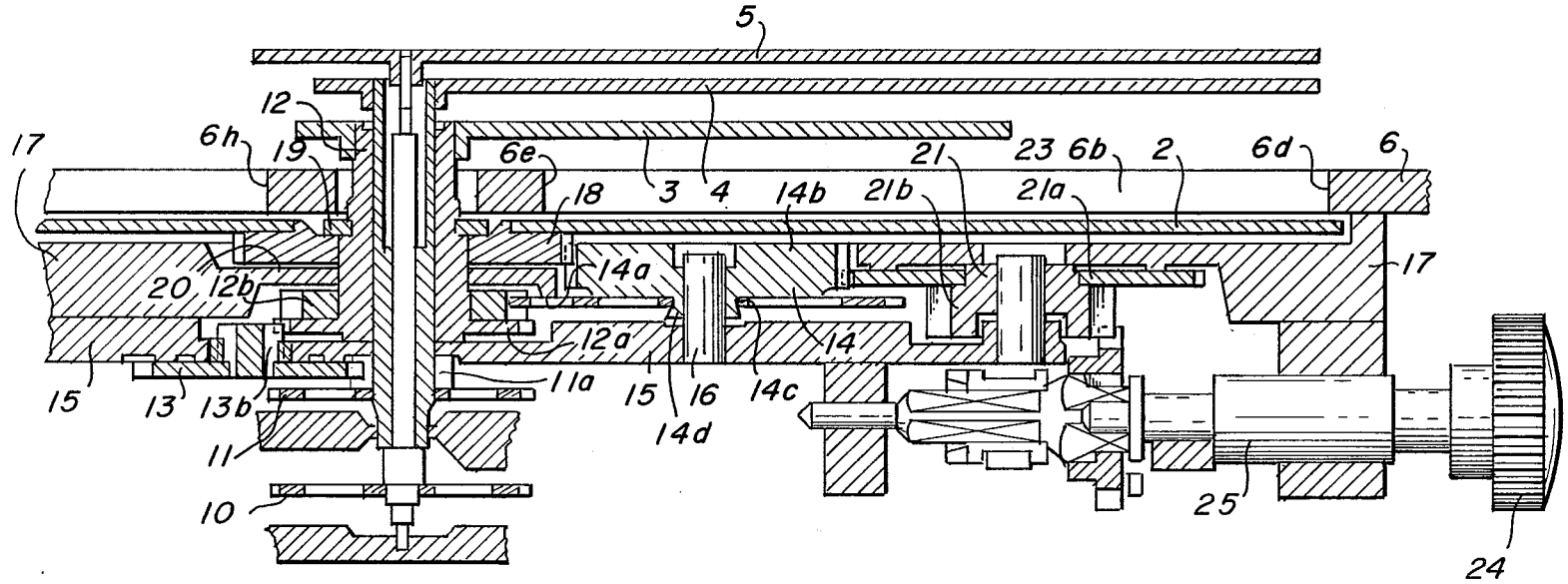
FIG. 4 is a sectional view partly showing a gear train relating to the star display.

Referring to FIGS. 4 and 5, a gear train particularly relating to the first star display 7 comprises a fourth wheel (or second hand wheel) 10 carrying the second hand 5, a center wheel 11 carrying the minute hand 4, and an hour wheel 12 comprising a gear 12a and a pinion 12b and carrying the hour hand 3. The hour wheel 12 is provided between a plate 15 and a bridge 17 so as to be slightly moved in the axial direction and held by a spring washer 20 provided for preventing the influence of the backlash of the gear train. A minute wheel 13 is engaged with a pinion 11a of the center wheel 11, and a pinion 13b of the minute wheel 13 is engaged with the hour wheel gear 12a. The hands 3, 4 and 5 are driven by an electric motor 27 through a gear train 28.

A regulating wheel 14 comprises a gear 14a engaged with the hour wheel pinion 12b, a pinion 14b engaged with a star map disk wheel 18, and a friction engaging portion 14c provided between a boss 14d of the pinion 14b and gear 14a. The regulating wheel 14 is rotatably mounted on a pin (or shaft) 16 secured to the plate 15 and supported by the bridge 17. The friction engaging portion 14c is adapted to slip at a load larger than a predetermined torque. The star map disk wheel 18, to which the star map disk 2 is secured, is rotatably mounted on the shaft of hour wheel 12 and supported between the bridge 17 and a washer 19 with a slight axial play. An intermediate correcting wheel 21 comprises a gear 21a meshed with the regulating wheel pinion 14b and a pinion 21b secured to the gear 21a and engaged with a clutch wheel 22. The pinion 21b is rotatably mounted on a pin 23 secured to the plate 15 and supported by the bridge 17. As is well known, the clutch wheel 22 is axially slidably mounted on a stem 25 connected to a crown 24. The crown 24 is normally positioned at the innermost position 24a and is adapted to be axially pulled to the intermediate position 24b and the outermost position 24c as shown in FIG. 1.

When the crown 24 is rotated at the normal position 24a, the stem 25 is rotated idle so that the clutch wheel 22 is not rotated. In the intermediate position 24b, the stem 25 is positioned to be coupled with the clutch wheel 22, so that the rotation of the crown 24 is transmitted to the intermediate correcting wheel 21 through the stem 25 and the clutch wheel 22. At the outermost position 24c, the stem 25 is released from the clutch wheel 22.

The reduction ratio from the fourth (or second hard) wheel 10 to the center wheel pinion 11a is set to 1/60 as is well known. The reduction ratio from the pinion 11a to the hour wheel 12 through the minute wheel 13 is 1/12, so that the hour wheel 12 rotates one revolution per twelve hours.

On the other hand, the star map disk 2 is rotated one revolution per one sidereal day as described below. One mean sidereal day, that is, one mean rotation of the earth with respect to the vernal equinox is equal to the mean solar time of 23 hours(h) 56 minutes(m) 4.091 seconds(s). In order to equalize a rotational speed of the star map disk 2 to an apparent mean rotational speed of the celestial sphere, the star map disk wheel 18 should rotate 1.0027379 (24 h/23 h 56 m 4.091 s) rotation per day. Therefore, the gear ratio of the gear train from the hour wheel 12 to the star map disk wheel 18 must be set so that the wheel 18 may rotate at a speed which is very close to the above speed. In the range of the number of teeth between 12 and 73, when the hour wheel pinion 12b is 3N teeth and the regulating wheel pinion 14b is 61 teeth, the most preferable number of the regulating wheel gear 14a being 5N teeth and that of star map disk wheel 18 being 73 teeth (wherein N is an integer between 3 and below 14). In this condition, the wheel 18 rotates 1.0027397 per day and an accumulated difference in a year between the disk 2 and the apparent mean rate of the celestial sphere is only 0.2 degrees.

In this embodiment, the hour wheel 12 is made by combining the gear 12*a* and pinion 12*b* which are separately manufactured. Accordingly, the number of teeth of the pinion 12*b* can be properly determined regardless of the engagement with the minute wheel 13. Further, as shown in FIG. 5, since the regulating wheel 14 is provided between the hour wheel 12 and star map disk wheel 18, the star map disk 2 secured to the wheel 18 is rotated in the same direction as the hour hand 3. In other words, the star map on the disk 2 rotates in the same direction as the rotation of the southern part of the celestial sphere around the celestial south pole.

Describing operations for an initial set of the star map disk, the crown 24 is pulled to the outermost position 24*c* and rotated to coincide the hour hand 3 and the minute hand 4 with the position of 12 o'clock. Then the difference of time in longitude with respect to a standard time is corrected. For example, the culmination of the fixed atar and sun in Tokyo is about 19 minutes earlier than that of the standard time at longitude 135° E. Thus, the hour and minute hands 3 and 4 are set 11 h 41 m in the morning. Next, the time of the right ascension 9*c* corresponding to the date 9*d* of the second star display 8 is read out. For example, on Aug. 30 in Tokyo, the sidereal time is approximately 10 h 32 m at noon in the mean year in longitude 135° E.

The crown 24 is pushed to the intermediate position 24*b*, the stem 25 is coupled with the clutch wheel 22. The clutch wheel 22 is rotated in cooperation with the crown 24 through the stem 25 and the pinion 14*b* of the regulating wheel 14 is rotated through the intermediate correcting wheel 21. During the transmission, the friction engaging portion 14*c* slips, so that the regulating wheel gear 14*a* is not rotated and hour and minute hands 3 and 4 continue to rotate. Thus, the star map disk 2 mounted on the wheel 18 which is meshed with the regulating wheel pinion 14*b* is rotated to a desired position. In the case of the above example, the 10 h 32 m position of the right ascension 2*d* on the disk 2 coincides with the marker 6*a*' by rotating the crown 24.

The crown 24 is again pulled to the outermost position 24*c*. By rotating the crown, the hour and minute hands 3 and 4 and the star map disk 2 are rotated, and the hands are positioned for indicating the actual time. Then the crown 24 is pushed to the innermost position 24*a* to start the watch. As shown in FIG. 1, when the actual time is at 10 h 9 m 39 s in the morning on Aug. 30 in Tokyo (corrected difference of time in longitude is +19 m), the local sidereal time is approximately at 9 o'clock.

Thus, the star map disk 2 rotates together with hour hand 3, thereby indicating positions of stars and sun in the sky within the opening 6*b* of the dial 6.

Further, by rotating only the star map disk 2 with the crown 24 at the intermediate position 24*b*, the time period from sunrise to sunset and twilight is indicated without stopping the hour, minute and second hands 3, 4, 5. More particularly, the star map disk 2 is rotated to coincide with the solar position 2*e* of a particular day with the horizon curve 6*e* at the east side, which indicates the sunrise condition. Nominal sidereal time is read, for example at the marker 6*a*'. Thereafter, the disk 2 is rotated to coincide the solar position 2*e* with the west side line of the horizon curve 6*e*, so that the nominal sidereal time at the sunset is indicated at the marker 6*a*'. Thus, the difference of time between both the nominal sidereal times corresponds to the time of period from sunrise to sunset of the particular day. Further, the difference of time between the nominal sidereal time when the solar position 2*e* passes the west side line of the horizon curve 6*e* and the nominal sidereal time when the solar position passes the astronomical twilight definition line 6*i* corresponds to the astronomical twilight of the day.

It will be understood that the astronomical twilight definition line may be replaced with a line defining the civil twilight. Although the star map shows a southern part of the celestial sphere around the celestial south pole, a star map showing a northern part of the celestial sphere around the celestial north pole may be provided. In such a watch the rotational direction of the star map disk 2 is inverted by inserting an idler in the gear train from the hour wheel 12 to the star map disk wheel 18. Further, it is possible to include stars which are visible at a portion in the southern hemisphere using an arrangement of declination different from the above described arrangement, if mechanical conditions of the watch coincide with actual celestial conditions. The second star display may be provided on a member other than the back 9, such as a glass of the watch, watch band, and other members.

Figure 6:
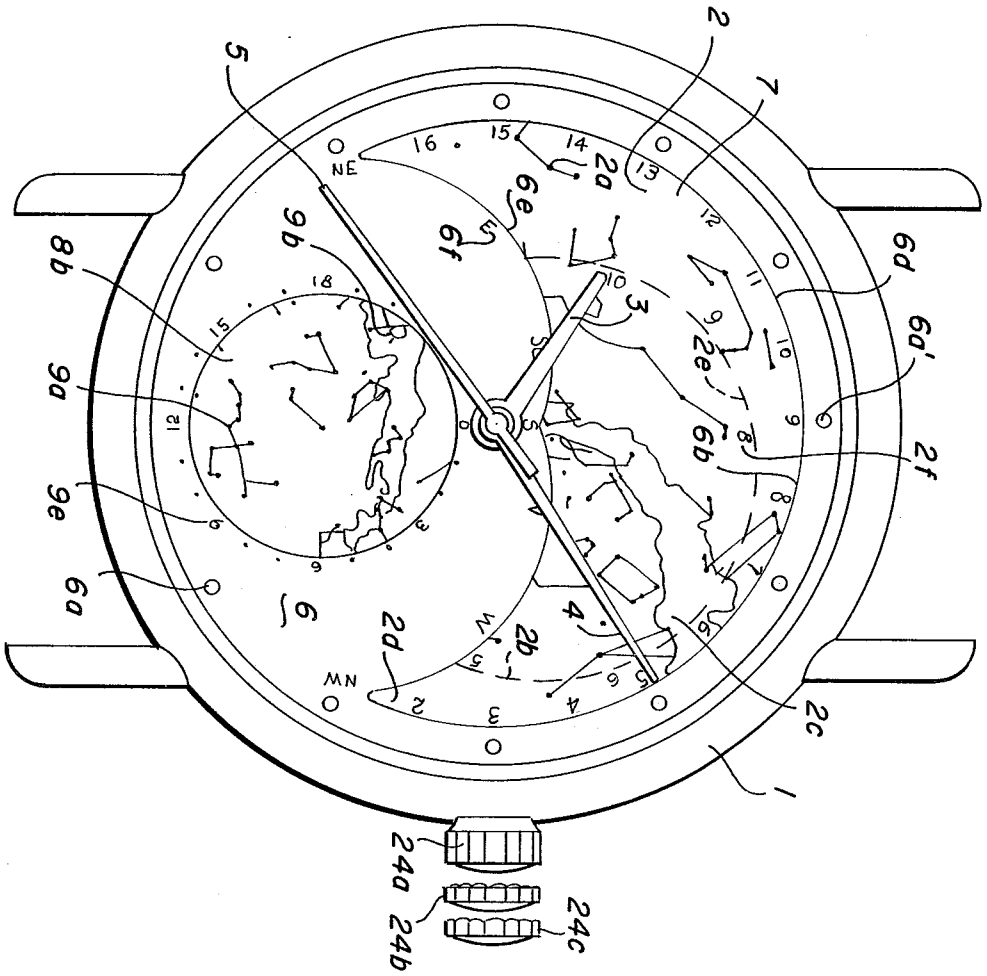
FIG. 6 is a plan view showing a second embodiment of the present invention.

FIG. 6 shows an example of the second star display. In the second embodiment of the present invention, the dial 6 is not provided with a window corresponding to the window 6*c* in the first embodiment, instead a second star display 8*b* corresponding to the second star display 8 of the first embodiment is provided on the dial 6. The second star display 8*b* indicates the times of the right ascensions 9*e* in the same manner as the first embodiment. Other components are the same as the first embodiment and identified by the same reference numerals, and the operation of the watch is the same as the first embodiment.

Figure 7:
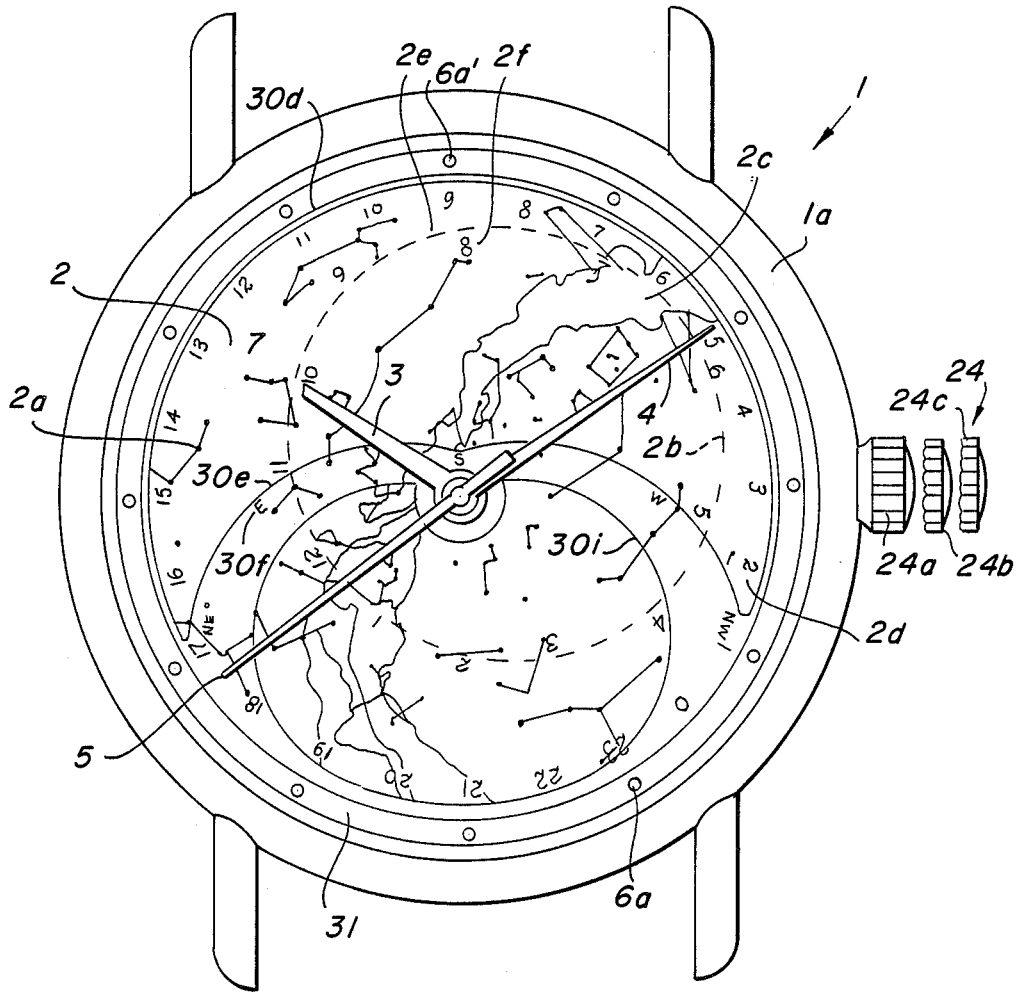
FIG. 7 is a plan view showing a further embodiment of the present invention.
Figure 8:
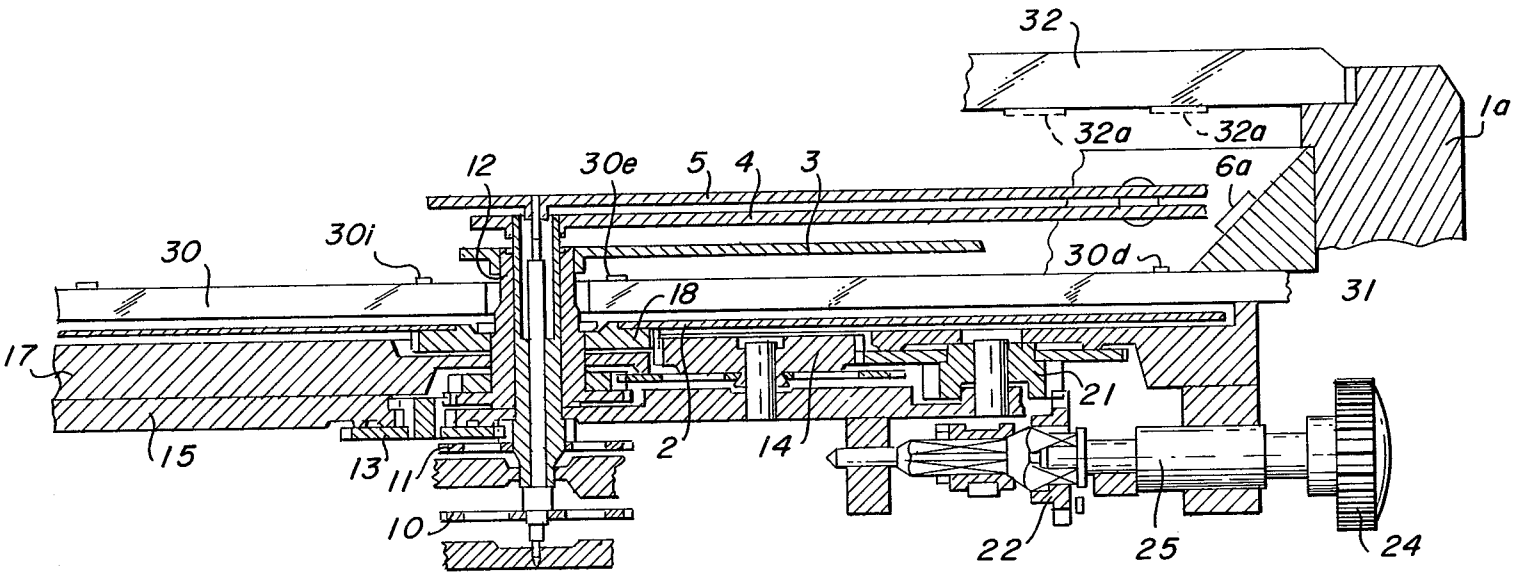
FIG. 8 is a sectional view of a part of FIG. 7.

Referring to FIGS. 7 and 8 showing another embodiment of the present invention, the same parts as the first embodiment are identified to the same reference numerals as those of corresponding Figures. In this embodiment, a transparent disk 30 is provided above the star map disk 2. An annular peripheral ring 31 is disposed along the inside wall of the watchcase 1*a*. Markers 6*a* for representing one to twelve hours are provided on a slant of the ring 31. A line 30*d* corresponding to the arc 6*d* of FIG. 1, line 30*e* corresponding to the horizon curve 6*e*, line 30*i* corresponding to the curve 6*i* for defining an astronomical twilight and characters 30*f* are printed on the transparent disk 30. Other portions and members are the same as those of the first embodiment. In this example, since lines for defining necessary ranges in the star map are provided on the transparent disk 30, all stars on the star map disk 2 are visible.

The defining lines may be provided on the underside of a case glass 32 as shown by chain lines 32*a*.

While the invention has been described in conjunction with preferred specific embodiments thereof, it will be understood that this description is intended to illustrate and not limit the scope of the invention, which is defined by the following claims.

What is claimed is:

1. A timepiece comprising:

a case;

an hour hand operatively associated with hour wheel means, said hour wheel means being rotatably mounted in said case and including an hour wheel pinion;

a minute hand disposed coaxially with said hour hand and operatively associated with said hour wheel means;

a star map disk rotatably mounted in said case below said hands and disposed coaxially with said hour wheel means, said star map disk having a diameter substantially equal to the rotational diameter of said minute hand and said star map disk including a star map disk wheel operatively associated with said star map disk;

gear train means for transmitting rotation of said hour wheel means to said star map disk to rotate said star map disk one revolution per one sidereal day, said gear train means including a regulating wheel means having a regulating wheel shaft rotatably mounted in said case, a regulating wheel gear mounted on said regulating wheel shaft and engaged with said hour wheel pinion, a regulating wheel pinion mounted on said regulating wheel shaft and engaged with said star map disk wheel, and friction engaging means for allowing said regulating wheel gear and said regulating wheel pinion to slip so as to allow said star map disk to be set without rotating said hands;

a first star map provided on said star map disk, said first star map including stars of constellations in a part of the celestial sphere which are selected from stars visible at an observation point on the earth; and celestial defining means provided on said first star map for defining a range in said first star map which is visible at an observation point on the earth.

2. The timepiece according to claim 1 wherein the stars of said first star map are arranged around a celestial pole which is disposed at the center of said star map disk.

3. The timepiece according to claim 1 wherein said celestial defining means has a substantially crescent shape, and includes a horizon line indicating a horizon and a zenith line defining about the zenith.

4. The timepiece according to claim 1 wherein said defining means comprises lines printed on a surface of a transparent member disposed above said star map disk.

5. The timepiece according to claim 1 wherein said defining means comprises lines printed on an underside of a case glass of said timepiece.

6. The timepiece according to claim 1 wherein said defining means comprises an opening formed in a dial means disposed on said first star map.

7. The timepiece according to claim 1 further comprising a second star map showing stars in a range other than that of said first star map.

8. The timepiece according to claim 7 wherein said second star map includes circumpolar stars.

9. The timepiece according to claim 1 wherein said first star map includes means for indicating solar positions.

10. The timepiece according to claim 8 wherein said second star map is provided on a back side of said case.

11. The timepiece according to claim 1 further comprising means for defining a twilight.

12. A timepiece comprising:

a case;

an hour hand operatively associated with an hour wheel means, said hour wheel means being rotatably mounted in said case and including an hour wheel gear and an hour wheel pinion;

a minute hand operatively associated with said hour wheel means;

a star map disk rotatably mounted in said case below said hands and disposed coaxially with said hour wheel means, said star map disk having a diameter substantially equal to the rotational diameter of said minute hand and including a star map disk wheel operatively associated with said star map disk;

gear train means for transmitting rotation of said hour wheel means to said star map disk to rotate said star map disk one revolution per one sidereal day, said gear train means including a regulating wheel means having a regulating wheel shaft rotatably mounted in said case, a regulating wheel gear mounted on said regulating wheel shaft and engaged with hour wheel pinion, a regulating wheel pinion mounted on said regulating wheel shaft and engaged with said star map disk wheel, a regulating wheel boss operatively associated with said regulating wheel gear and regulating wheel pinion, and a friction engaging means operatively associated with said regulating wheel boss for allowing said regulating wheel gear and said regulating wheel pinion to slip so as to allow said star map disk to be set without rotating said hands;

an intermediate correcting wheel means rotatably mounted in said case, said intermediated correcting wheel being operatively associated with said gear train means for rotating said regulating wheel means and said star map disk;

a first star map provided on said star map disk, said star map including stars of constellations in a part of the celestial sphere which are selected from stars visible at an observation point on the earth; and celestial defining means provided on said first star map for defining a range in said first star map which is visible at an observation point on the earth.

13. The timepiece according to claim 12, wherein said celestial defining means comprises an opening formed in a dial means disposed on said first star map, said celestial defining means including a horizon means indicating a horizon and a zenith line defining about the zenith.

14. The timepiece according to claim 12, wherein said timepiece includes a stem rotatably mounted in said case and extending outside of said case, said stem having a clutch wheel disposed in said case and mounted on said stem, said clutch wheel engaging said intermediate correcting wheel means, and said stem having a crown disposed outside said case for rotating said stem, wherein upon rotating said crown said gear train means is driven so as to in turn drive said hands and said star map disk.

* * * * *